US005420554A

United States Patent [19]

Gehrke

[11] Patent Number: 5,420,554

[45] Date of Patent: May 30, 1995

[54] METHOD AND APPARATUS FOR ADJUSTING A RESONANT FREQUENCY OF A TRANSMISSION LINE RESONATOR ASSEMBLY

[75] Inventor: James K. Gehrke, Lake in the Hills, Ill.

[73] Assignee: Motorola, Inc., Schaumburg, Ill.

[21] Appl. No.: 220,146

[22] Filed: Mar. 30, 1994

[51] Int. Cl.[6] ..... H01P 7/08; H01P 7/04

[52] U.S. Cl. ..... 333/235; 333/219; 333/223

[58] Field of Search ..... 333/202-207, 333/219, 222, 223, 235

[56] References Cited

U.S. PATENT DOCUMENTS

| | | | |
|---|---|---|---|
| 4,583,064 | 4/1986 | Makimoto et al. | 333/219 |
| 5,032,807 | 7/1991 | Petrovic | 333/219 |
| 5,218,330 | 6/1993 | Omiya et al. | 333/223 |
| 5,304,968 | 4/1994 | Ohtonen et al. | 333/223 X |

FOREIGN PATENT DOCUMENTS

| | | | |
|---|---|---|---|
| 0508733 | 10/1992 | European Pat. Off. | 333/202 |
| 0323902 | 11/1992 | Japan | 333/202 |

*Primary Examiner*—Seungsook Ham
*Attorney, Agent, or Firm*—Daniel C. Crilly; James A. Coffing

[57] ABSTRACT

A transmission line resonator assembly (100) employs a method and apparatus for adjusting its resonant frequency. The transmission line resonator assembly (100) comprises a resonator portion (101) and an electrically conductive member (102). The resonator portion (101) is operable at the resonant frequency and includes a transmission line (103) that is disposed on a dielectric material (104). A first portion (106) of the transmission line (103) is electrically coupled to a signal common (109) by a first coupling impedance. The electrically conductive member (102) includes a first deflectable surface (113) lying substantially along a first plane (201) and is coupled to the resonator portion (101) and the signal common (109), such that the first deflectable surface (113) is positioned substantially adjacent to the transmission line (103). By deflecting at least a portion of the first deflectable surface (113) with respect to the first plane (201), the first coupling impedance is altered, thereby adjusting the resonant frequency.

15 Claims, 1 Drawing Sheet

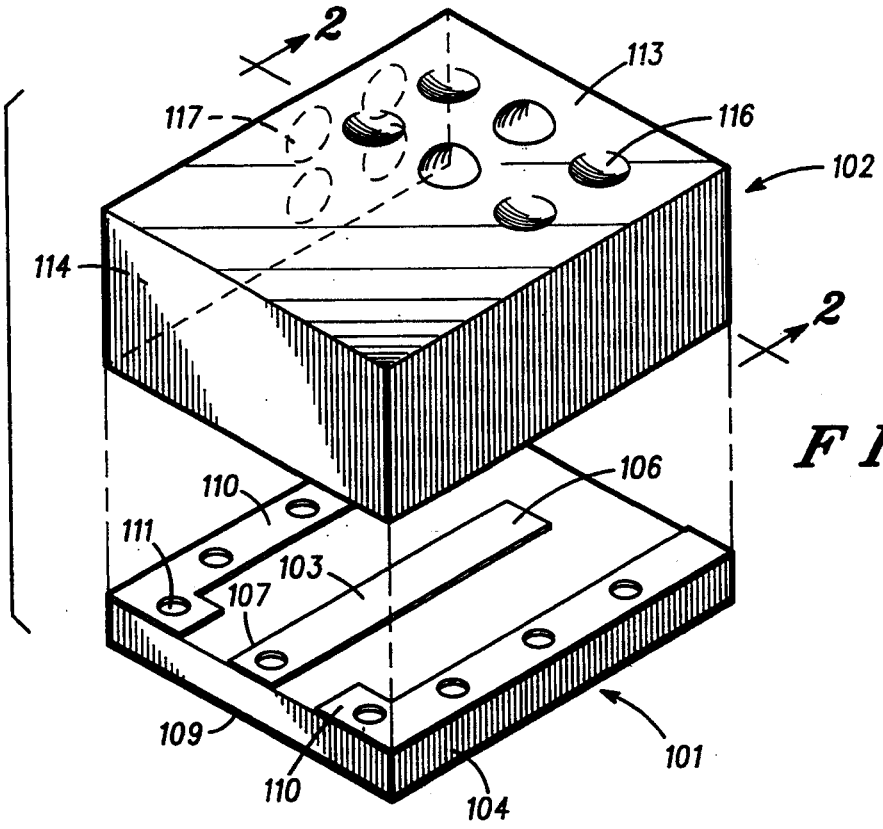
FIG. 1
100
FIG. 2
200
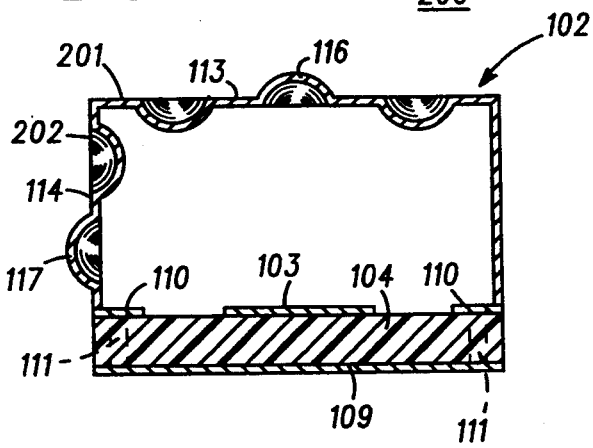
FIG. 3
300
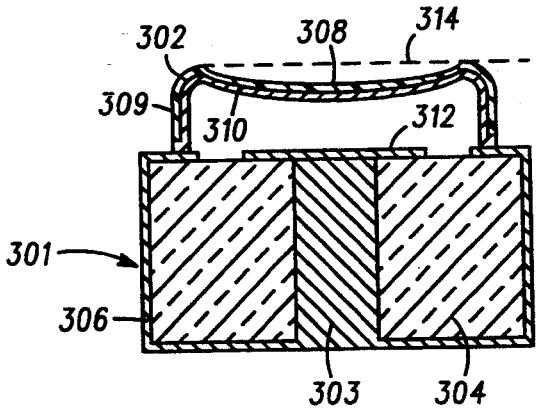

METHOD AND APPARATUS FOR ADJUSTING A RESONANT FREQUENCY OF A TRANSMISSION LINE RESONATOR ASSEMBLY

FIELD OF THE INVENTION

The present invention relates generally to transmission line resonators and, in particular, to a method and apparatus for adjusting a resonant frequency of a transmission line resonator assembly.

BACKGROUND OF THE INVENTION

Transmission line resonators are known to comprise a transmission line that is disposed on a dielectric material. One end of the transmission line is typically short-circuited (i.e., connected to ground), while the other end is typically open-circuited and capacitively coupled to ground. The open-circuited end of the transmission line is used to interconnect the transmission line resonator with other circuitry—for example, to a transistor in an oscillator circuit.

Transmission line resonators are most commonly fabricated as either a dielectric block resonator or a planar microstrip resonator. In the dielectric block configuration, the transmission line is deposited along the inside surface of a hole in a block of alumina ceramic or barium tetratitanate, which hole extends through the center of the block. The outer five sides (i.e., the four sides parallel to the transmission line and the bottom end) of the block are typically plated with an electrically conductive material, such as copper or tin, and are connected to ground and one end of the transmission line. The top end of the block includes two areas of electrically conductive plating. The first area is located about the periphery of the top end and is connected to ground. The second area is an isolated area of plating that is connected to the open end of the transmission line. The second area of plating capacitively couples the open end of the transmission line to ground.

In the planar microstrip configuration, the transmission line is deposited, or etched, onto one side of a printed circuit board material. The other side of the printed circuit board material contains a ground plane that extends beneath the transmission line. One end of the transmission line is typically grounded via an electrically conductive throughhole and the other end is capacitively coupled to ground via one, or more, discrete capacitors.

In either of the above resonator configurations, the resonant frequency of the transmission line resonator is determined by calculating the parallel impedance produced by the coupling capacitance and the effective impedance of the short-circuited transmission line (typically an inductive reactance), and setting the parallel impedance equal to infinity. The resonant frequency is given by the following equation:

$$f_r = 1/(2\pi)(L_t C_c)^{\frac{1}{2}} \qquad \text{(Equation 1)}$$

where $f_r$ is the resonant frequency, $L_t$ is the effective inductance of the short-circuited transmission line, and $C_c$ is the coupling capacitance.

Adjustment of the resonant frequency is typically accomplished using one of a variety of tuning techniques depending on the type of transmission line resonator. For example, a dielectric block resonator might be tuned to a particular resonant frequency by removing the plating that is attached to the open end of the transmission line. This plating removal is typically performed using a laser or a sand blaster. When a laser is used, the laser vaporizes a path in the plating that effectively cuts away a portion of the plating that is connected to the open end of the transmission line, thereby reducing the coupling capacitance and increasing the resonant frequency. Thus, laser tuning permanently adjusts the resonant frequency in only one direction (i.e., increasing). In addition, laser tuning typically reduces the quality factor (Q) of the resonator, especially when the dielectric block is constructed of a material with a high dielectric constant (e.g., greater than 30). That is, heating a localized area of the dielectric material increases the dielectric loss tangent of the dielectric material and lowers the effective Q of the dielectric material. Further, laser tuning requires specialized equipment (i.e., a laser) to complete the process.

Similar to laser tuning, sand blasting removes a portion of the plating that is connected to the open end of the transmission line. This is accomplished by propelling pressurized sand at the portion of the area that is to be removed. Unlike laser tuning, sand blasting does not degrade the resonator's Q; however, sand blasting is a dirty process that requires specialized propulsion and vacuum equipment.

A third known resonant frequency adjustment technique commonly used to tune dielectric block resonators is drilling. With this technique, recesses or holes are drilled in the dielectric block adjacent to the transmission line to alter the effective dielectric constant of the dielectric block, thereby changing the effective impedance of the transmission line. Similar to laser tuning and sand blasting, the drilling process permanently adjusts the resonant frequency in only one direction and requires specialized equipment.

To adjust the resonant frequency of a typical planar microstrip transmission line resonator, the value of the discrete coupling capacitor, or the number of discrete coupling capacitors, is increased or decreased depending on whether the resonant frequency is to be decreased or increased, respectively. Similar to the aforementioned techniques, this method requires specialized equipment (e.g., a soldering iron) and results in an essentially permanent alteration of the resonant frequency. That is, in order to reverse the direction of the resonant frequency adjustment, the specialized equipment must be employed again.

Therefore, a need exists for a method and apparatus to adjust the resonant frequency of a transmission line resonator assembly while facilitating dynamic, bi-directional frequency adjustment. Further, such a method that resulted in effective tuning while maintaining resonator Q, and without requiting the use of specialized equipment, would be an improvement over the prior art.

BRIEF DESCRIPTION OF THE DRAWINGS

FIG. 1 illustrates an exploded, perspective view of a transmission line resonator assembly, in accordance with the present invention.

FIG. 2 illustrates a cross-sectional view of the transmission line resonator assembly of FIG. 1.

FIG. 3 illustrates a cross-sectional view of an alternate transmission line assembly, in accordance with the present invention.

DESCRIPTION OF A PREFERRED EMBODIMENT

Generally, the present invention provides a method and apparatus for adjusting a resonant frequency of a transmission line resonator assembly. The transmission line resonator assembly comprises a resonator portion and an electrically conductive member. The resonator portion is operable at the resonant frequency and includes a transmission line that is disposed on a dielectric material. A first portion of the transmission line is electrically coupled to a signal common by a first coupling impedance and a second portion of the transmission line is operably coupled to the signal common by a second coupling impedance. The electrically conductive member includes a first deflectable surface lying substantially along a first plane and is coupled to the resonator portion and the signal common, such that the first deflectable surface is positioned substantially adjacent to the transmission line. By deflecting at least a portion of the first deflectable surface with respect to the first plane, the first, or second, coupling impedance is altered, thereby adjusting the resonant frequency. By adjusting the resonant frequency in this manner, the present invention facilitates bi-directional adjustments of the resonant frequency, as opposed to the single directional adjustment provided by prior art processes, such as laser tuning and sand blasting.

The present invention can be more fully described with reference to FIGS. 1–3. FIG. 1 illustrates an exploded, perspective view of a transmission line resonator assembly 100, in accordance with a preferred embodiment of the present invention. The transmission line resonator assembly 100 is operable at a resonant frequency and comprises a resonator portion 101 and an electrically conductive member 102. The resonator portion 101 includes a transmission line 103 and a signal common 109 (e.g., a ground plane), both of which are disposed on a dielectric material 104. As shown, a resonator coupling portion 106 of the transmission line 103 remains open-circuited, while a grounded portion 107 of the transmission line 103 is directly connected to the signal common 109 via an electrically conductive throughhole 111. It should be noted that the grounded portion 107 of the transmission line 103 might alteratively be capacitively or inductively coupled to the signal common 109. In either of the alternative cases, a corresponding coupling impedance would exist between the grounded portion 107 of the transmission line 103 and the signal common 109.

In a preferred embodiment, the transmission line 103 has an electrical length of approximately one-eighth wavelength of the transmission line resonator assembly's resonant frequency. The dielectric material 104 preferably comprises a printed circuit board material, such as commercially available cyanate ester, polyimide, teflon, or FR4, although other materials, such as alumina ceramic, might alternatively be used. Fabrication of transmission lines on dielectric materials is well-known in the art, thus no further discussion will be presented except to facilitate an understanding of the present invention.

In a preferred embodiment, the electrically conductive member 102 comprises a metallized plastic enclosure having two, or more, side surfaces 114 (three shown) and a top deflectable surface 113. However, in an alternate embodiment of the present invention, the electrically conductive member 102 might comprise only a side deflectable surface (e.g., 114) constructed from a metal, such as aluminum or copper. The metallized plastic enclosure 102 is preferably formed by plating an electrically conductive material, such as copper or tin, on the inside and/or outside surfaces of a plastic enclosure 102, as later described.

In a preferred embodiment, a top deflectable surface 113 of the electrically conductive member 102 lies substantially along a first plane and includes a plurality of protuberances 116 integrally disposed therein. Each of the protuberances 116 are positioned at predetermined locations along the top surface 113 such that they reside substantially above the resonator coupling portion 106 of the transmission line 103 upon fabrication of the complete transmission line resonator assembly 100. Each protuberance 116 is preferably circular in shape with a diameter in the range of three millimeters to seven millimeters. In an alternate embodiment, a side deflectable surface 114 might also include a plurality of protuberances 117 as shown in FIG. 1.

To assemble the preferred transmission line resonator assembly 100, the electrically conductive member 102 is positioned upon the dielectric material 104 such that the top deflectable surface 113 is substantially adjacent to the transmission line 103. The electrically conductive member 102 is then attached, via solder or conductive epoxy, to electrically conductive receptacle pads 110 on the dielectric material 104. Upon assembly of the transmission line resonator assembly 100, the electrically conductive member 102 is electrically coupled to the signal common 109 by a plurality of electrically conductive throughholes 111 that connect the electrically conductive receptacle pads 110 to the signal common 109.

FIG. 2 illustrates a cross-sectional view 200 of the assembled transmission line resonator assembly 100 along the 2—2 line of FIG. 1. As depicted in FIG. 2, the electrically conductive member 102 is attached to the dielectric material 104 and is electrically coupled to the signal common 109 via the electrically conductive receptacle pads 110 and throughholes 111. In a preferred embodiment, as briefly mentioned above, the top deflectable surface 113 of the electrically conductive member 102 lies substantially along a geometric plane 201 and is positioned above the transmission line 103. Nevertheless, in an alternate embodiment, a side deflectable surface 114 of the electrically conductive member 102 might lie substantially along a geometric plane 202 and be positioned substantially along side the transmission line 103.

In the preferred embodiment, the top deflectable surface 113 is located approximately five millimeters above the surface of the transmission line 103 to permit sufficient adjustment of the capacitive coupling impedance that exists between the resonator coupling portion 106 of the transmission line 103 and the signal common 109. This capacitive coupling results from the inherent capacitance that exists between the resonator coupling portion 106 and the signal common 109 through the dielectric material 104 and between the resonator coupling portion 106 and the top deflectable surface 113 through the air. In the preferred embodiment, only the top deflectable surface 113 of the electrically conductive member 102 includes integrally disposed protuberances 116, while the side surfaces (e.g., 114) are positioned substantially orthogonal to the top surface 113 to provide structural integrity to the electrically conductive member 102. However, as briefly mentioned above, a side surface (e.g., 114) might additionally, or alternatively, include integrally disposed protuberances 117 to facilitate the resonant frequency adjustment.

The present invention provides adjustment of the resonant frequency of the transmission line resonator 100 in the following manner. Upon fabrication of the transmission line resonator assembly 100, the assembly 100 is operable at a particular resonant frequency. In a preferred embodiment, the resonant frequency is given by Equation 1, wherein $C_c$ is the combined parallel impedance formed by the capacitive coupling that exists between the resonator coupling portion 106 of the transmission line 103 and the signal common 109 and $L_t$ is the effective inductance of the transmission line 103.

The resonant frequency is adjusted by deflecting one, or more, of the protuberances 116, with respect to the geometric plane 201, either toward or away from the transmission line 103. These deflections are readily accommodated by the preferred electrically conductive member 102 since a substantially plastic top deflectable surface 113 is more readily deflectable by hand than is a substantially metallic surface 113. Once deflected, the protuberances 116 preferably reside approximately three millimeters above, or below, the geometric plane 201. Thus, deflection of the protuberances 116 respectively increases, or decreases, the coupling capacitance between the resonator coupling portion 106 of the transmission line 103 and the signal common 109, thereby changing the resonant frequency. Thus, in contrast to permanent, single direction prior art adjustment techniques, the present invention facilitates dynamic, bidirectional resonant frequency adjustments (e.g., initially increasing the resonant frequency and later decreasing it) by deflecting the protuberances 116 in the corresponding directions with respect to the geometric plane 201. When protuberances 117 are integrally disposed within a side deflectable surface 114, adjustment of the resonant frequency is similarly achieved by deflecting the protuberances 117 toward or away from the resonator coupling portion 106 of the transmission line 103.

It should be noted that when the grounded portion 107 of the transmission line 103 is not directly connected to the signal common 109, the coupling impedance present between the grounded portion 107 and the signal common 109 is summed with the effective impedance of the transmission line 103, prior to calculating the combined parallel impedance, to determine the resonant frequency of the transmission line resonator assembly 100 and any adjustments thereto. In this case, the resonant frequency is given by:

$$f_r = 1/(2\pi)(C_c L_{eff}) \quad \text{(Equation 2)}$$

where $L_{eff}$ is the effective inductance provided by the series combination of the transmission line 103 and the coupling impedance between the grounded portion 107 of the transmission line 103 and the signal common 109. Therefore, additional protuberances 116 might be included in the top deflectable surface 113, or in a side deflectable surface (e.g., 114), of the electrically conductive member 102 to alter the coupling impedance between the grounded portion 107 of the transmission line 103 and the signal common 109, and to thereby adjust the resonant frequency.

FIG. 3 illustrates a cross-sectional view of a transmission line resonator assembly 300, in accordance with an alternate embodiment of the present invention. The transmission line resonator assembly 300 comprises a resonator portion 301 and an electrically conductive member 302. In this embodiment, the resonator portion 301 comprises a well-known dielectric block resonator that includes a transmission line 303 disposed on a dielectric block 304, such as alumina ceramic or barium tetratitanate. The transmission line 303 is connected to a signal common 306 at one end and is open-circuited at the other end as shown. The open-circuited end of the transmission line 303 is preferably connected to an electrically conductive layer 312 that is disposed upon the dielectric block 304 substantially perpendicular to the transmission line 303. The electrically conductive layer 312 provides capacitive coupling between the transmission line 303 and the signal common 306.

The electrically conductive member 302 comprises a top deflectable surface 308 (shown in its deflected state) and at least two side surfaces 309 connected to the top surface 308. The electrically conductive member 302 might be fabricated from a formed metal, such as aluminum or copper, or from a molded plastic having an electrically conductive plating 310 disposed on the top deflectable surface 308 and the side surfaces 309. The side surfaces 309 mechanically support the top deflectable surface 308 above the electrically conductive layer 312 and provide electrical continuity between the top deflectable surface 308 and the signal common 306.

Assembly of the transmission line resonator assembly 300 is similar to the assembly of the transmission line resonator 100, except that in this embodiment the deflectable portion of the top surface 308 is positioned above the electrically conductive layer 312 that resides on a top end of the dielectric block 304. The electrically conductive member 302 is preferably attached to the dielectric block 304 by soldering, or conductive epoxying, the side surfaces 309 of the electrically conductive member 302 to the signal common 306.

Once assembled, the transmission line resonator assembly 300 is operable at a resonant frequency. In this embodiment, the resonant frequency is adjusted by deflecting the top surface 308 of the electrically conductive member 302, with respect to a geometric plane 314, either toward (as shown in FIG. 3) or away from the electrically conductive layer 312. In a manner analogous to the resonant frequency adjustment described above with regard to FIG. 2, the deflection of the top surface 308 alters the coupling capacitance between the electrically conductive layer 312 and the signal common 306, thereby producing the resonant frequency adjustment.

The present invention provides a method and apparatus for adjusting a resonant frequency of a transmission line resonator assembly. With this invention, the resonant frequency may be dynamically increased or decreased without necessitating the use of specialized equipment, such as lasers, drilling machines, or sand blasting equipment. In addition, the present invention provides adjustment of the transmission line resonator's resonant frequency without negatively impacting the quality factor of the resonator, as is common when using laser adjustment techniques. Further, by providing an integrally disposed deflectable surface, the present invention eliminates the need to use additional hardware to alter the coupling impedance and adjust the resonant frequency.

What is claimed is:

1. A method for adjusting a resonant frequency of a transmission line resonator assembly, the method comprising the steps of:

a) providing a resonator portion of the transmission line resonator assembly that is operable at the resonant frequency;

b) coupling an electrically conductive member to the resonator portion, wherein the electrically conductive member includes a first deflectable surface lying substantially along a first plane, the first deflectable surface including a plurality of protuberances that can each be deflected in one of only two positional states including a first state on a first side of the first plane and a second state on a second side of the first plane; and c) deflecting at least one of the plurality of protuberances from the first state to the second state, such that the resonant frequency is adjusted.

2. The method of claim 1, wherein step (a) comprises the step of disposing an electrically conductive layer upon a dielectric material, such that the electrically conductive layer forms the transmission line resonator assembly.

3. The method of claim 1, wherein step (b) further comprises the step of:

b1) positioning the first deflectable surface substantially adjacent to the transmission line resonator assembly.

4. The method of claim 3, wherein step (b1) comprises the step of positioning the first deflectable surface above the transmission line resonator assembly.

5. The method of claim 1, wherein the resonator portion is a dielectric block resonator, and wherein step (b) comprises the step of attaching the electrically conductive member to a first end of the dielectric block resonator, such that the first deflectable surface is positioned substantially above an electrically conductive layer that is disposed on the first end.

6. A transmission line resonator assembly comprising:

a resonator portion that includes a transmission line that is disposed on a dielectric material, wherein a first portion of the transmission line is electrically coupled to a signal common by a first coupling impedance and wherein a second portion of the transmission line is electrically coupled to the signal common by a second coupling impedance; and an electrically conductive member, operably coupled to the signal common and the resonator portion, that includes a first deflectable surface lying substantially along a first plane, the first deflectable surface including a plurality of protuberances that can each be deflected in one of only two positional states including a first state on a first side of the first plane and a second state on a second side of the first plane; wherein the first deflectable surface is positioned substantially adjacent to the transmission line and wherein deflection of at least one of the plurality of protuberances from the first state to the second state substantially adjusts the first coupling impedance.

7. The transmission line resonator assembly of claim 6, wherein the first deflectable surface further comprises an electrically conductive plating disposed thereon.

8. The transmission line resonator assembly of claim 6, wherein the electrically conductive member further comprises a second deflectable surface that is operably coupled to the first deflectable surface, wherein the second deflectable surface lies substantially along a second plane.

9. The transmission line resonator assembly of claim 8, wherein the second deflectable surface is positioned substantially orthogonal to the first deflectable surface.

10. The transmission line resonator assembly of claim 6, wherein the dielectric material comprises alumina ceramic.

11. The transmission line resonator assembly of claim 6, wherein the dielectric material comprises barium tetratitanate.

12. The transmission line resonator assembly of claim 6, wherein the dielectric material comprises a printed circuit board material.

13. The transmission line resonator assembly of claim 6, wherein the first coupling impedance and the second coupling impedance each comprises a capacitive reactance.

14. The transmission line resonator assembly of claim 6, wherein the second coupling impedance comprises an inductive reactance.

15. A transmission line resonator assembly that is operable at a resonant frequency, comprising:

a resonator portion that includes a transmission line disposed upon a printed circuit board material, wherein the transmission line has an electrical length substantially equivalent to one-eighth wavelength at the resonant frequency, wherein a first portion of the transmission line is electrically coupled to a signal common by a capacitive reactance, and wherein a second portion of the transmission line is directly connected to the signal common; and an electrically conductive member, operably coupled to the signal common and the resonator portion, that includes a first deflectable surface lying substantially along a first plane, wherein the first deflectable surface is positioned substantially above at least the first portion of the transmission line, wherein the first deflectable surface has a plurality of protuberances integrally disposed therein, wherein the plurality of protuberances are positioned at predetermined locations along the first deflectable surface, and wherein deflection of at least one of the plurality of protuberances with respect to the first plane substantially adjusts the capacitive reactance.

* * * * *